US006240865B1

(12) United States Patent
Hubbard

(10) Patent No.: US 6,240,865 B1
(45) Date of Patent: Jun. 5, 2001

(54) MULTI-PURPOSE SAILING KIT ASSEMBLY

(76) Inventor: Richard L. Hubbard, 11191 Rivendall Ct., Pinckney, MI (US) 48169

( * ) Notice: Subject to any disclaimer, the term of this patent is extended or adjusted under 35 U.S.C. 154(b) by 0 days.

(21) Appl. No.: 09/376,163

(22) Filed: Aug. 17, 1999

(51) Int. Cl.[7] ..... B63B 35/00
(52) U.S. Cl. ..... 114/39.28; 114/61.1
(58) Field of Search ..... 114/61.1, 61.18, 114/123, 353, 354, 39.28

(56) References Cited

U.S. PATENT DOCUMENTS

| | | | | |
|---|---|---|---|---|
| 3,986,219 | | 10/1976 | Michowski . | |
| 4,061,100 | | 12/1977 | Muhlfeld . | |
| 4,337,543 | * | 7/1982 | Van Ulzen | 114/354 |
| 4,524,709 | | 6/1985 | McKenna . | |
| 4,557,210 | | 12/1985 | Gerwin | 114/357 |
| 4,681,333 | | 7/1987 | Rouge et al. | 280/87.04 |
| 4,706,597 | | 11/1987 | Figone | 114/353 |
| 4,730,573 | | 3/1988 | Koon | 114/353 |
| 4,740,000 | | 4/1988 | Moessner | 280/87.04 |
| 4,753,183 | | 6/1988 | Jira | 114/98 |
| 4,766,830 | | 8/1988 | Kunz | 114/354 |
| 4,771,723 | | 9/1988 | Friesen | 114/162 |
| 4,821,666 | | 4/1989 | Ingram | 114/347 |
| 4,829,925 | | 5/1989 | Haanen | 114/43 |
| 4,838,196 | | 6/1989 | Ingram | 114/347 |
| 4,926,774 | | 5/1990 | Winner | 114/123 |
| 4,930,433 | | 6/1990 | Tirez | 114/354 |
| 5,024,177 | | 6/1991 | Winter et al. . | |
| 5,042,411 | | 8/1991 | Krolczyk . | |
| 5,285,742 | | 2/1994 | Anderson | 114/279 |
| 5,331,916 | | 7/1994 | Martin | 114/347 |
| 5,377,607 | | 1/1995 | Ross | 114/363 |
| 5,450,809 | * | 9/1995 | Melton | 114/353 |
| 5,592,892 | | 1/1997 | Kerckhoff | 114/162 |
| 5,642,686 | | 7/1997 | Jeswine | 114/354 |
| 5,680,828 | | 10/1997 | Kayaks | 114/347 |
| 5,704,305 | | 1/1998 | Winter | 114/39.1 |
| 5,887,538 | | 3/1999 | Cruz | 114/274 |

* cited by examiner

*Primary Examiner*—Jesus D. Sotelo
(74) *Attorney, Agent, or Firm*—Gifford, Krass, Groh, Sprinkle, Anderson & Citkowski, P.C.

(57) ABSTRACT

A multi-purpose sailing kit assembly including at least one, and preferably two separate hulls. Each of the hulls further includes first and second elongated, buoyant and self-contained halves which are pivotally secured together along a longitudinal direction. Each of the pairs of hull halves further include first and second longitudinal and perpendicularly extending planar surfaces such that the halves may be converted from a first cross sectional profile to a second cross sectional profile. Coupling mechanisms are provided for engaging within selectively formed circular openings in the planar surfaces of the hull halves and locking engage the hull halves together in the desired cross sectional profile. A frame is provided and secures first and second convertible hulls together in a spaced manner or, alternatively, supports outriggers in a spaced manner relative to a single hull. A sailing mast is capable of being mounted to a location of the upwardly facing surface of a selected hull halve or to a specified location along the frame.

20 Claims, 10 Drawing Sheets

MULTI-PURPOSE SAILING KIT ASSEMBLY

BACKGROUND OF THE INVENTION

1. Field of the Invention

The present invention relates generally to sailing vessels and sailing kits and, more particularly, to a multi-purpose sailing kit assembly which incorporates one or more hull convertible hulls.

2. Description of the Prior Art

The prior art is well documented with examples of small sail or manually driven watercraft and which are capable of being converted from one operating configuration to another. U.S. Pat. No. 4,524,709, issued to McKenna, discloses a collapsible and wind propelled water craft including three equidistantly spaced support members arranged in a tetrahedral frame and including a pair of sails supported upon the frame.

Examples of catamaran-style boats with collapsible frames are illustrated in U.S. Pat. No. 3,986,219, issued to Michowski, and U.S. Pat. No. 4,766,830, issued to Kunz. In the example of Michowski, a rectangular shaped frame supports the first and second hull portions. In the example of Kunn, the rectangular frame includes a covering member and an attachment for supporting an upwardly extending mast and sail.

Additional examples of wind sailing devices with first and second surfboards supported by a frame are shown in U.S. Pat. No. 5,024,177, issued to Winter, and U.S. Pat. No. 4,930,433, issued to Tirez. In each case, a pair of integral planar boards are supported by the frame structure, which also anchors the mast and sail extending upwardly therefrom.

U.S. Pat. No. 4,061,100, issued to Muhlfeld, discloses a sailboat conversion kit capable of reconfiguring a conventional sailboat for traversing a hard surface such as ice. The kit includes an elongated spar assembly mounted transversely on the hull of the sailboat intermediate its ends and which are spaced from the port and starboard sides of the sailboat. First and second surface engaging structures, in the form of blades, mount to outboard ends of the spar assembly and a third surface engaging structure is coupled to a tiller of the sailboat beneath its stern end. The hull assembly in Muhlfeld is likewise of an integral and one-piece design.

SUMMARY OF THE PRESENT INVENTION

The present invention is a multi-purpose sailing kit assembly which, in addition to certain convertibility capabilities known in the prior art, teaches a novel assembly for reconfiguring a cross sectional profile of a hull or hull assemblies of the sailboat. Additionally, the present invention provides a much wider potential range of conversion designs for the sailing kit assembly than is taught or suggested by the prior art.

The kit assembly according to the present invention includes at least one, and preferably two, hulls. Each of the hulls is constructed as first and second elongate, buoyant and self-contained halves. Each of the hull halves extends in an elongate, longitudinal direction and further includes a three dimensional cross section defining in part a first planar surface and a second perpendicularly extending planar surface connected to the first planar surface along a longitudinally and common edge.

The halves of each hull are pivotally secured together and are capable of being converted from a first cross sectional hull profile and in which the a first selected planar surface of each halve is pivoted in an abutting relationship to a second cross sectional hull profile in which the hull halves are pivoted so that a second selected planar surface of each halve is in the abutting relationship and the first selected planar surfaces now define a continuous upwardly facing platform surface. First and second pluralities of spaced apart and longitudinally extending sleeve portions are formed along common connecting edges of the first and second hull halves and, upon aligning the halves together, receive one or more elongate pins for pivotally associating the halves together.

The hull halves are capable of being secured according to the desired cross sectional profile by specified circular openings formed in the first and second planar surfaces of each hull halve. Upon pivoting the halves to a desired profile, coupling mechanisms are insertably engaged with aligning circular openings and are tightened to anchor the halves together in a seal-tight and water-resistant manner. Rubber plugs are provided for sealing circular openings not employed for purposes of anchoring the halves together and additional plugs are provided which are configured for either supporting in horizontally extending fashion elongate tubular members making up a frame of the sailing kit assembly or for supporting in upwardly extending fashion a sailing mast.

Additional variants are provided in which a single hull, both first and second hulls, or a selected one of first and second hulls, are separated into its distinctive halves by disengaging the pin from the aligning sleeve portions. The elongate tubular frame may be constructed so as to support the first hull in a canoe or kayak arrangement or, alternatively, to construct the first and second hulls in any further desired spatial arrangement, such as exhibited by a catamaran style boat. Additional variants made possible by the kit assembly of the present invention include skate supports which may secured to remote extending ends of the tubular frame assembly to permit the kit to operate on an ice covered surface. Also, a canopy constructed of forward and rearward spaced portions may be attached upon a selected pair of first and second planar surfaces of a configured hull, a seat being installed upon the hull in an aperture defined between the forward and rearward spaced portions.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
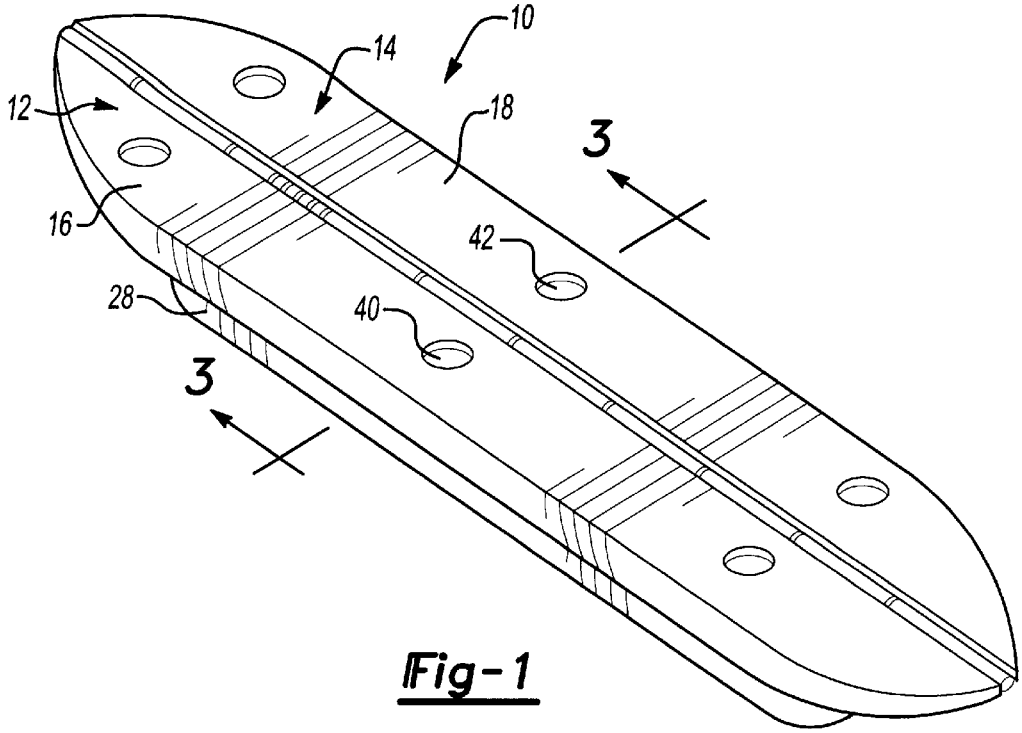
FIG. 1 is a perspective view of a first hull with pivotally associated and convertible halve portions according to a first selected cross sectional profile according to the present invention.
Figure 3:
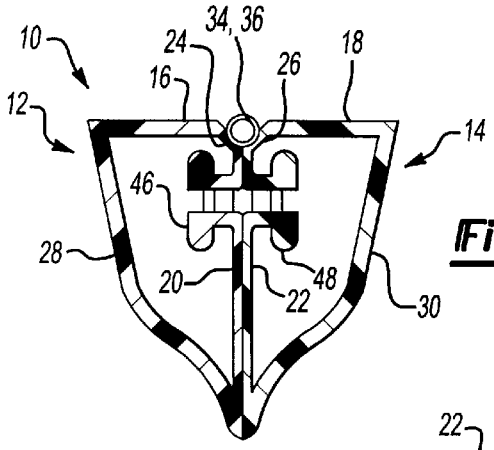
FIG. 3 a cut away view taken along line 3—3 of FIG. 1 and illustrating the first cross sectional profile of the hull according to the present invention.

Referring now to FIGS. 1 and 3, a hull 10 is illustrated according to a first configuration and which forms a part of an overall multi-purpose sailing kit assembly according to the present invention. The hull 10 is constructed of a first elongated, buoyant and self-contained halve 12 and a second likewise elongated, buoyant and self-contained halve 14. Typically, the self-contained halves 12 and 14 are each constructed of a lightweight and durable aluminum which provides a desired degree of buoyancy. However, it is understood that other materials can be employed in the construction of the hull 10 without departing from the scope of the instant invention.

Each of the hull halves 12 and 14 independently define in cross section a three dimensional profile, this profile including first planar surfaces 16 and 18, for halves 12 and 14, respectively, as well as second planar surfaces 20 and 22 which are secured along common and longitudinally extending edges 24 and 26 of the first and second halves 12 and 14 and which extend in substantially perpendicular fashion relative to the first planar surfaces 16 and 18. The hull halves 12 and 14 each further include a curved and interconnecting surface (likewise longitudinally extending) and which completes the cross sectional configuration of each of the hull halves. Specifically, first hull halve 12 includes a curved and interconnecting surface 28 and second hull halve likewise includes a curved and interconnecting surface 30 for completing the cross sectional profile of each of the hull halves.

Figure 4:
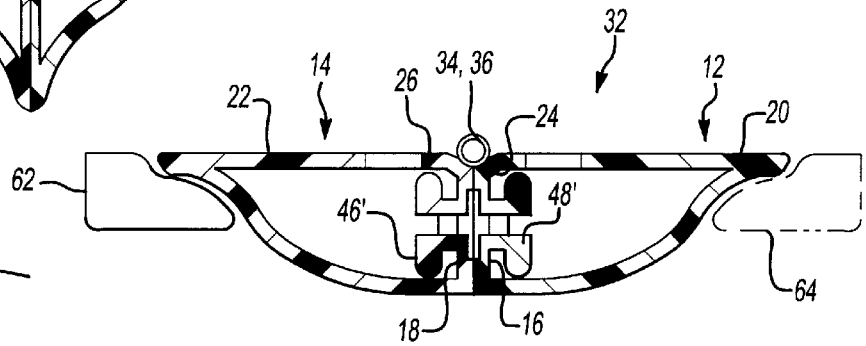
FIG. 4 is a cut away view taken along line 4—4 of FIG. 2 and illustrating the second cross sectional profile of the hull according to the present invention.
Figure 5:
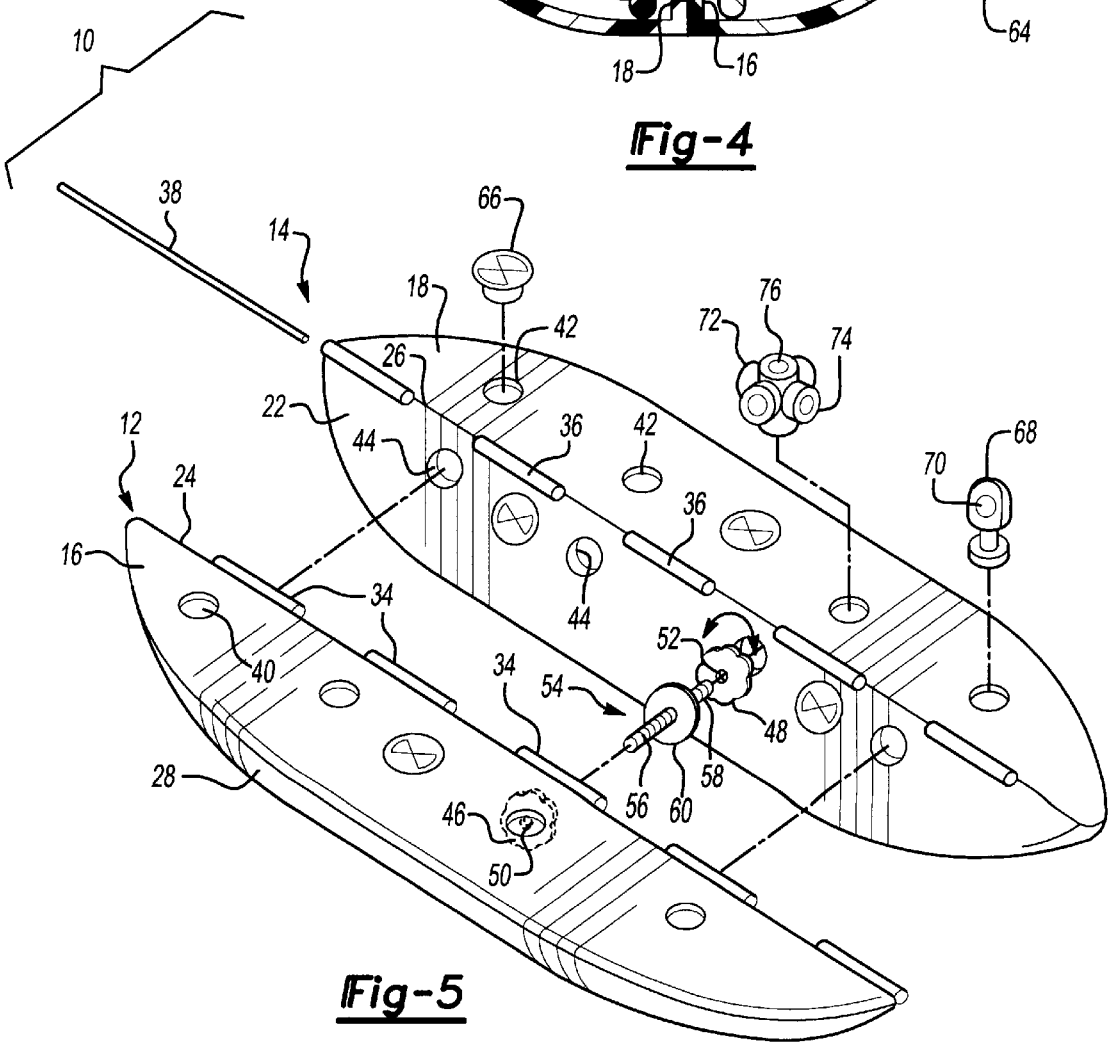
FIG. 5 is an exploded view illustrating the means for lockingly engaging and disengaging the first and second hull halves according to the present invention.

Referring to FIG. 3 again in combination with FIG. 5, the ability to convert the hull 10 from the first configuration to a second configuration (see at 32 in FIGS. 2 and 4) is illustrated. The ability to convert the halve portions 12 and 14 is provided by a first plurality of spaced apart sleeve portions 34 which secure along the common edge 24 of the first hull halve 12 and a second plurality of spaced apart sleeve portions 36 which secure along the common edge 26 of the second hull halve 14. The sleeve portions 34 and 36 are spaced in alternating fashion along the longitudinal lengths of the first and second halves 12 and 14 and, upon alignment with one another, receive in longitudinally inserting fashion at least one pin 38 for pivotally associating the halves 12 and 14 together.

Referring still to FIG. 5, a locking mechanism is provided for engaging the halves 12 and 14 together according to a desired converted and cross sectional profile and includes pluralities of circular openings, see at 40 for planar surface 16 of first halve 12 and at 42 and 44, respectively, for planar surfaces 18 and 22 of second halve 14. Although not shown in the perspective of FIG. 5, the first hull halve 12 includes likewise formed circular apertures at aligning locations along its hidden planar surface 20 and this is evident as well from the view of FIG. 3 and as also is shown at 43 in FIG. 2.

Situated against an inner facing surface of each of the internally hollowed hull halves 12 and 14, and proximate to the various circular apertures 40, 42, 44, are nuts (see at 46 in phantom and at 48 in solid in FIG. 5). Each of the nuts includes an outer "disk" shaped configuration which is secured against the interior facing surface of each of the hull halves (see again at 46) and further includes a central through hole (at 50 and 52 for nuts 46 and 48, respectively) which is interiorly threaded. A series of coupling mechanisms, illustrated by coupling mechanism 54, is provided for engaging the hull halves 12 and 14 through selected and aligning apertures and includes a laterally extending shaft with first 56 and second 58 exteriorly threaded ends for engaging, respectively, a selected pair of aligning and interiorly threaded through holes of the nuts which are positioned against the interiorly facing surfaces of each of the hull halves 12 and 14. A further disk 60 is secured in a centrally and fixed manner to the shaft and may be grasped by the user when spin tightening the shaft ends 56 and 58 within the nuts positioned behind the selected circular openings. It is also envisioned that appropriate surfaces of the nuts 46 and 48 and the disk 60 may be coated with an appropriate elastic and watertight material which, upon tightening of the coupling assemblies, causes the hull halves to retain their watertight and buoyant characteristics.

Figure 2:
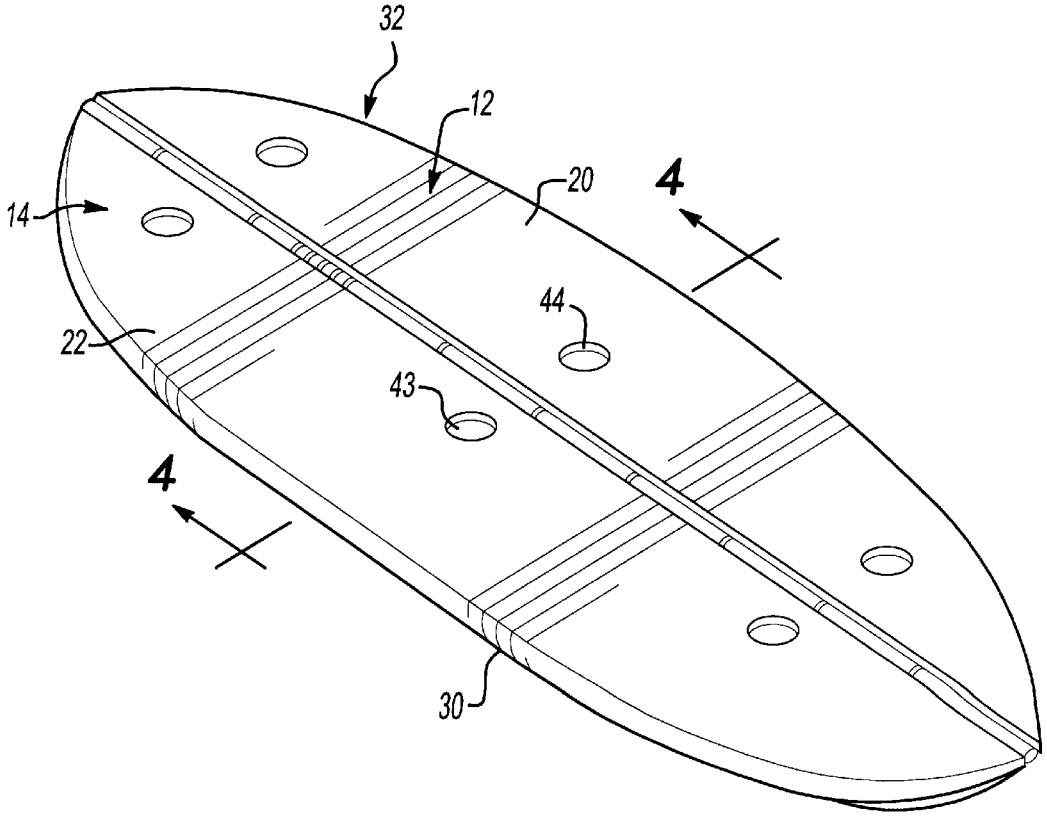
FIG. 2 is a perspective view of the first hull illustrated in FIG. 1 and converted to a second selected cross sectional profile according to the present invention.

In this manner, the hull halves 12 and 14 are converted from the cross sectional profile of FIGS. 1 and 3, in which the planar surfaces 16 and 18 face upwardly and define a narrower upwardly facing platform surface and correspondingly deeper keel (see in FIG. 3) to the cross sectional profile of FIGS. 2 and 4 and in which the planar surfaces 20 and 22 now face upwardly and define a wider upwardly facing platform surface and a correspondingly shallower keel (see in FIG. 4). Illustrated at 46' and 48' in FIG. 4 are additional nut portions which are otherwise not shown in the view of FIG. 5 and which are understood to be provided along the interior facing surface of specified circular openings to permit the pivoting conversion of the hull halves between the cross sectional profiles. As will be described in future reference to the succeeding embodiments, outriggers (see at 62 and 64 in FIG. 4) may be releasably secured to the hull assembly in any desired conversion to provide additional stability or flotation support within the scope of the present invention.

Referring back to FIG. 5, additional means are provided for sealing in a watertight manner circular openings in the various planar surfaces of the first and second hull halves 12 and 14 which are not otherwise engaged by the coupling mechanism 54. This includes the provision of rubberized and elastomeric plugs 66 which serve simply to engage a selected circular aperture (in this case an aperture 42) and to seal the interior of each of the hull halves 12 and 14. Additional sealing plugs 68 are provided in the form of an upwardly extending support portion defined by a central circular cavity 70 through which an elongate tubular member (not shown in this embodiment) is capable of being horizontally engaged. Finally, a yet further variation of a sealing plug is illustrated at 72 and includes a plurality of similarly horizontally directed cavities 74 for receiving the elongate tubular member, as well as a further vertically extending hole or cavity 76 for supporting in vertically securing fashion (again not shown in FIG. 5) a mast and sail.

Figure 6:
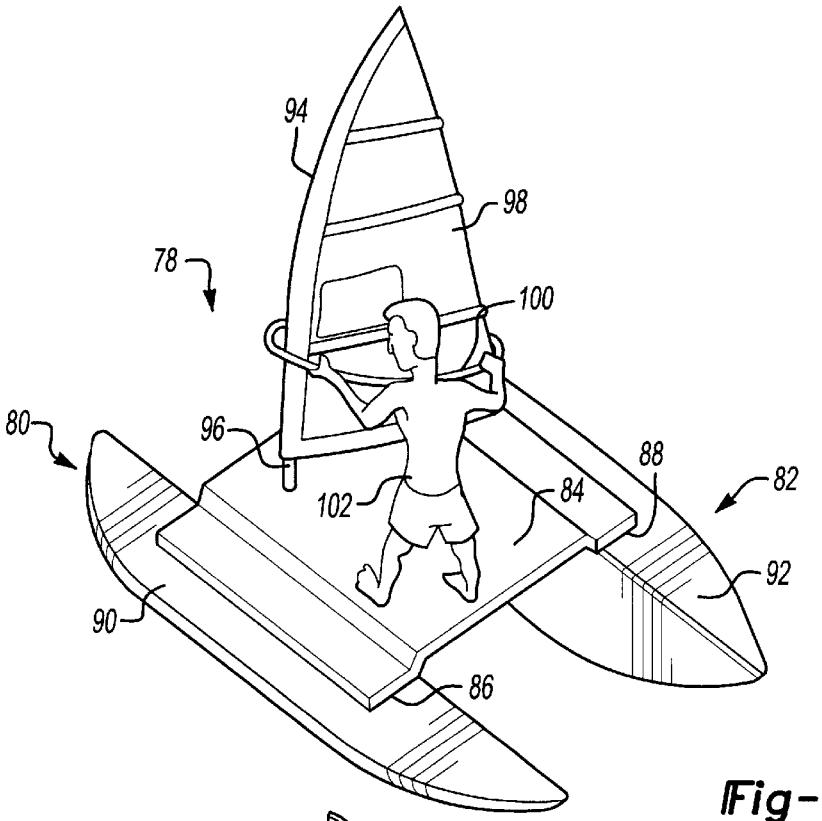
FIG. 6 is a perspective view of a further operative configuration illustrating a single disengaged and frame supported hull according to the present invention.

Beginning at FIG. 6, and progressing through the remaining illustrations, a number of different operative embodiments are illustrated for the multi-purpose sailing kit according to the present invention. Illustrated at 78 in FIG. 6 is a perspective view of a further operative configuration of the present invention and showing a single disengaged and frame supported hull with first halve 80 and second halve 82. The halves 80 and 82 are constructed in substantially identical fashion to those disclosed at 12 and 14, such that a repeat of such structure as the pivotally securing means and locking mechanisms are unnecessary for purpose of the furthering representations. A planar shaped platform 84 is provided which is preferably rectangular shaped and includes opposite and laterally extending edges which are downwardly stepped (see at 86 and 88) and which secure to corresponding upwardly facing surfaces 90 and 92 of the hull halves 80 and 82. A sail assembly 94 of conventional construction includes a mast portion engageable within a selected location of the platform 84. A sail 98 is secured to a mast and also includes a boom 100 which is operated by an individual 102 standing upon the platform 84.

Figure 7:
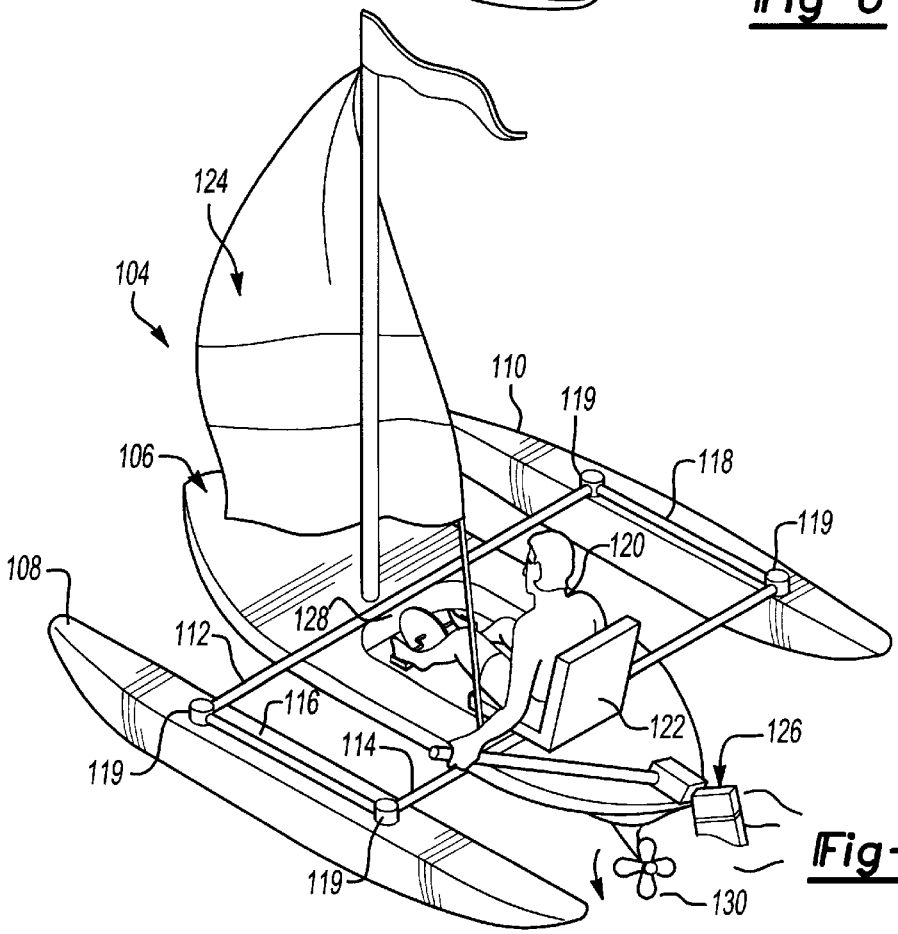
FIG. 7 is a perspective view of a yet further operative configuration illustrating a first operatively engaged and configured hull and a second disengaged hull secured to the first hull by an elongate frame structure according to the present invention.

Referring now to FIG. 7, a perspective view is illustrated at 104 of a yet further operative configuration illustrating a first operatively engaged and configured hull 106 and a second disengaged hull illustrated by outrigger portions 108 and 110 secured to the first hull by an elongate frame structure. The second hull constructed from the outrigger portions 108 and 110 may be identical to the first hull 106, the only difference being that the separated and converted outriggers may be illustrated in a rotated/converted fashion to define a different planar surface width and a deeper/shallower keel depth consistent with the disclosure of the hull halves 12 and 14 of the first preferred embodiment. The elongate frame structure in this embodiment is illustrated by a plurality of elongated tubular members as is shown by lateral extending main supports 112 and 114 and shortened and longitudinal extending and interconnecting end supports 116 and 118. Interconnecting ends of main supports and end supports may be anchored atop the outriggers through the use of additional supports 119 similar to those illustrated at 68 in FIG. 5 or may be as alternatively provided. An operator 120 may be supported upon a seat 122 secured to the upper surface of the hull 106 and may operate a sail assembly 124 in conjunction with a rudder 126. Additionally, or alternatively, a conventional pedaling assembly 128 for turning a propeller 130 may also be employed in the embodiment of FIG. 7 and within the scope of the present invention.

Figure 8:
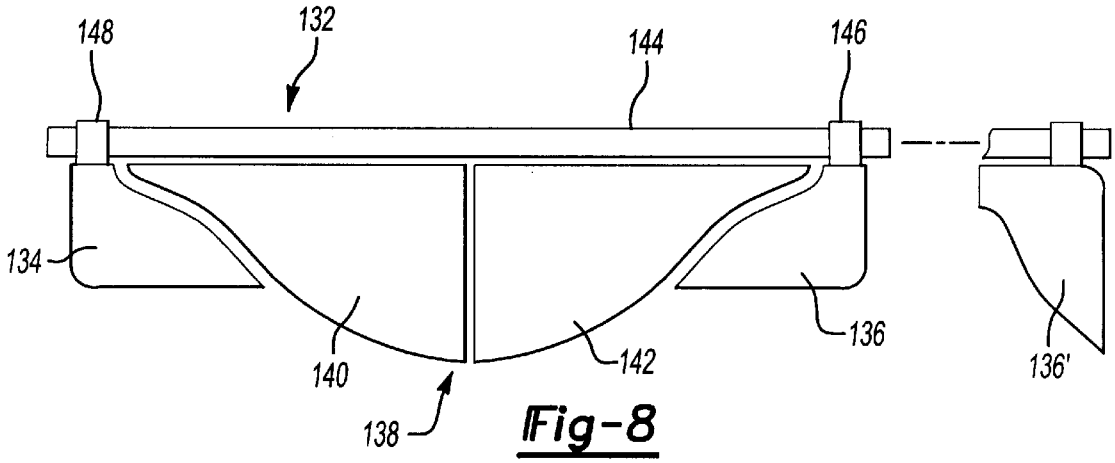
FIG. 8 is an end view similarly illustrating the configuration of FIG. 7 and in which first and second outriggers, consisting of a disengaged and second hull, are illustrated in closer lateral proximity to a central and first operatively engaged hull configuration.

Referring now to FIG. 8, an end view is shown at 132 similar to the illustration of the configuration of FIG. 7 (104) and in which first and second outriggers are illustrated at 134 and 136 in schematic and consist of a disengaged and second hull. The outriggers 134 and 136 are attached to opposite sides of a further hull 138, defined itself by halve portions 140 and 142, and supported by at least one laterally extending tubular member 144. Horizontal supports 146 for supporting the outriggers 134 and 136 at desired spaced locations from the hull 138 are illustrated both in closer lateral proximity to a central and first operatively engaged hull configuration 138, as well as more laterally and outwardly spaced as illustrated by displaced outrigger 136'.

Figure 9:
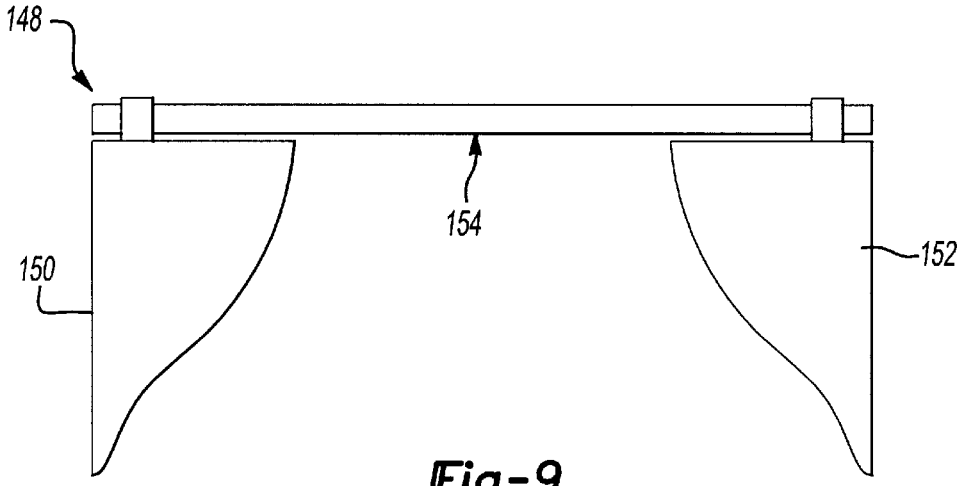
FIG. 9 is an end view of a further operative configuration of a single disengaged hull established according to a catamaran-style boat.
Figure 10:
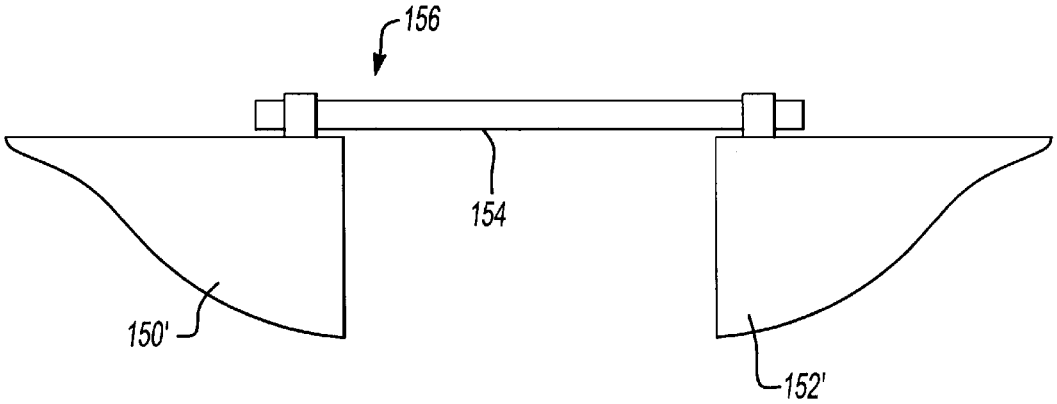
FIG. 10 is an end view similar to that shown in FIG. 9 and illustrating the disengaged hull halves in a rotated and different operative configuration.

FIG. 9 is an end view of a further operative configuration 148 of a single disengaged hull defined by halves 150 and 152 in a specified configuration and established according to a catamaran-style by supporting frame 154. FIG. 10 is an end view similar to that shown in FIG. 9 and illustrating, at 156, the disengaged hull halves in a rotated and different operative configuration 150' and 152'.

Figure 11:
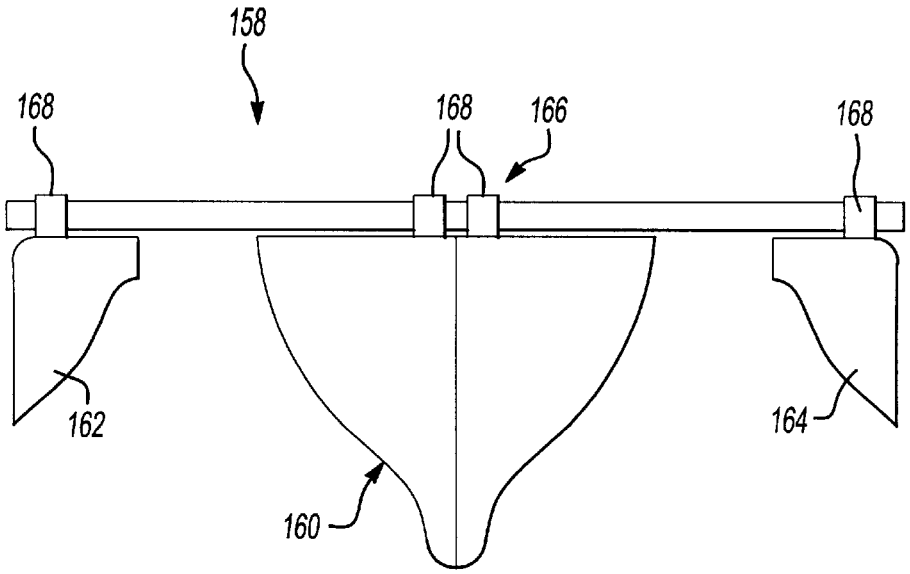
FIG. 11 is a view similar to that shown in FIG. 8 and illustrating the first engaged and configured hull and the second disengaged hull in a further operative embodiment according to the present invention.
Figure 12:
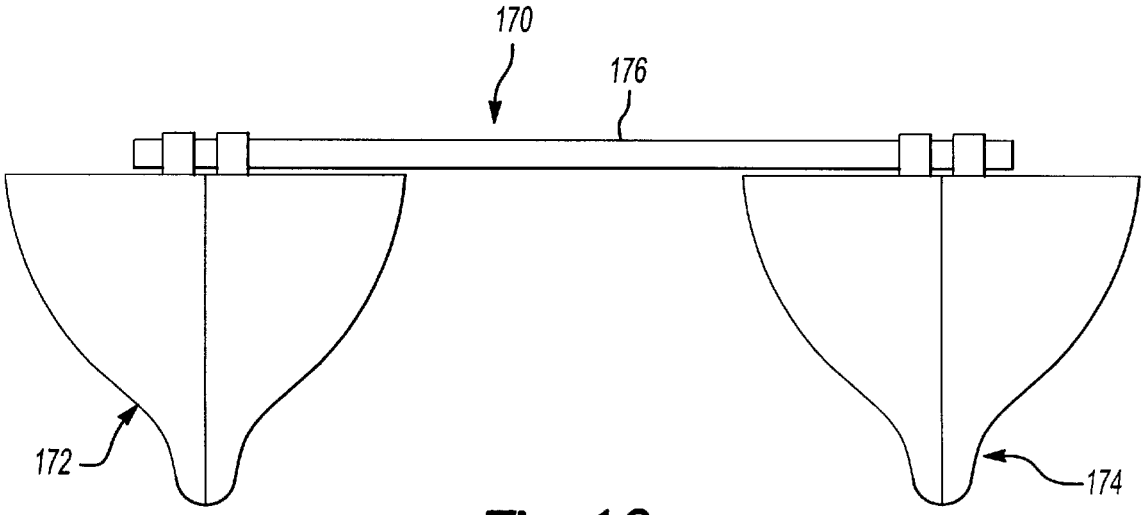
FIG. 12 is a yet further end view showing another configuration with first and second engaged and converted hulls separated in a standard catamaran-style by an elongated frame structure.

FIG. 11 is a view similar to that shown in FIG. 8 and illustrates, at 158, an assembled hull 160 constructed of halves, such as shown at 150 and 152 in FIGS. 8, 9 and 10, in addition to a second disengaged hull according to different dimensions and defined by halves 162 and 164 assembled in outrigger fashion and supported at laterally spaced locations from the assembled hull 160 again by the elongate tubular supports 166 and plurality of horizontal supports 168. FIG. 12 illustrates at 170 a yet further end view configuration of a catamaran style assembly and including first 172 and second 174 engaged hulls according to a desired cross sectional conversion and separated again by an elongated frame structure 176.

Figure 13:
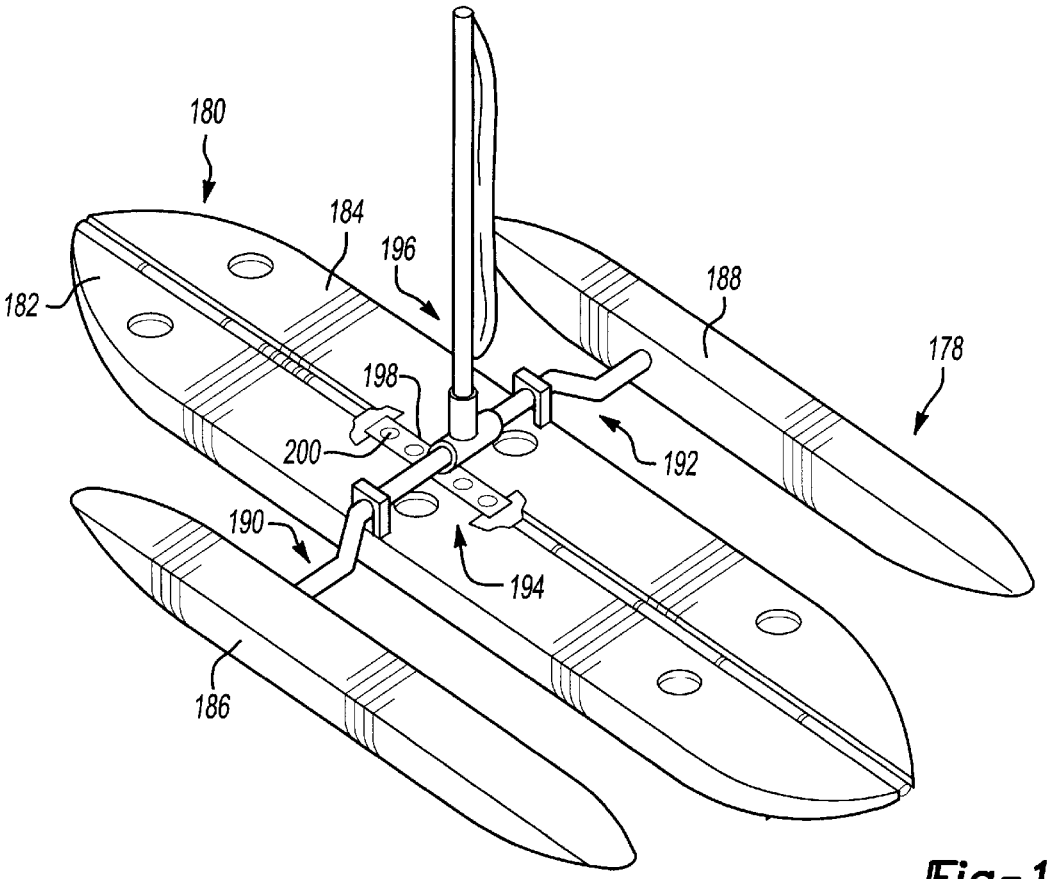
FIG. 13 is a perspective view of a yet further operative embodiment, similar to the representations of FIG. 7, and showing an alternative configuration for a tubular connecting frame and outrigger assembly according to the present invention.
Figure 14:
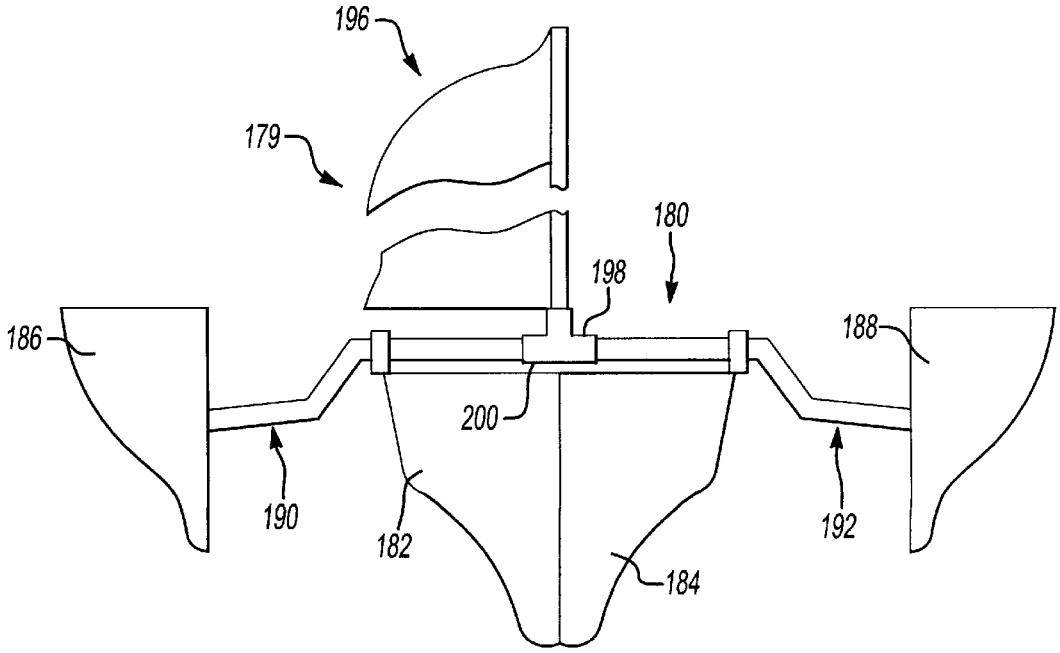
FIG. 14 is an end view of the embodiment illustrated in FIG. 13 according to the present invention.

FIG. 13 is a perspective view 178 and FIG. 14 an end view 179 of a yet further operative embodiment, similar to the representations of FIG. 7, and showing an alternative configuration for a tubular connecting frame and outrigger assembly according to the present invention. Specifically, a central assembled hull 180 includes halves 182 and 184 and a further pair of outriggers 186 and 188 are illustrated in a spaced relationship by means of elongate and curved tubular portions 190 and 192, respectively, which extend from a central support bracket 194 and which engage the outriggers at their remote extending ends. A mast assembly 196 is secured atop a fitting 198 (similar to that shown at 72 in FIG. 5), the fitting 196 in turn capable of being longitudinally adjusted along a length of the hull 180 by a series of mounting apertures formed in a mounting bracket 200 secured to the hull 180.

Figure 15:
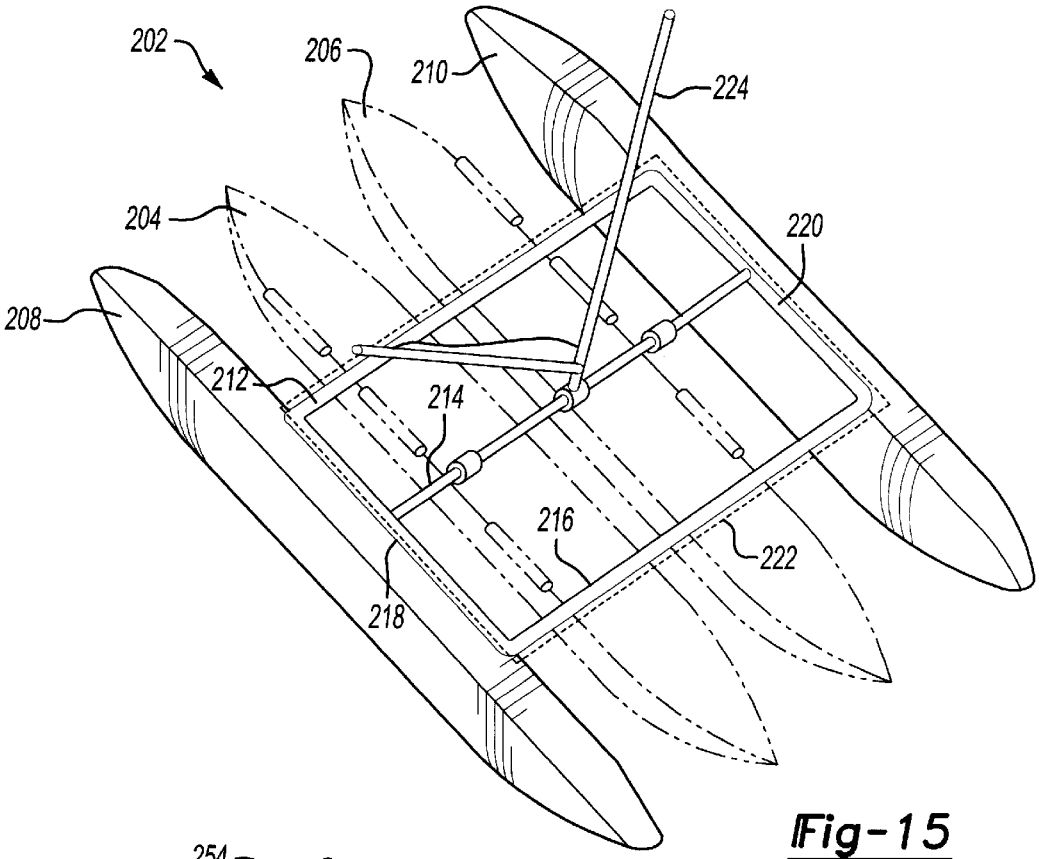
FIG. 15 is a perspective view of a yet further embodiment illustrating a first disengaged hull with a second pair of outwardly spatially mounted outriggers according to the present invention.

FIG. 15 is a perspective view at 202 of a yet further embodiment illustrating a first disengaged hull, illustrated by halves 204 and 206, and a second pair of outwardly spatially mounted outriggers 208 and 210 which are secured to the first disengaged hull by means of the frame constructed of elongate tubular members. Specifically, laterally extending tubular members 212, 214 and 216 are shown which are secured along opposite and longitudinally extending ends by end tubular members 218 and 220. A covering 222 (illustrated in outline in phantom) is stretched over the assembled interconnecting tubular members) and provides a platform support. A mast assembly 224 may also secure to an appropriate fitting of the tubular frame as previously described and extend upwardly therefrom.

Figure 16:
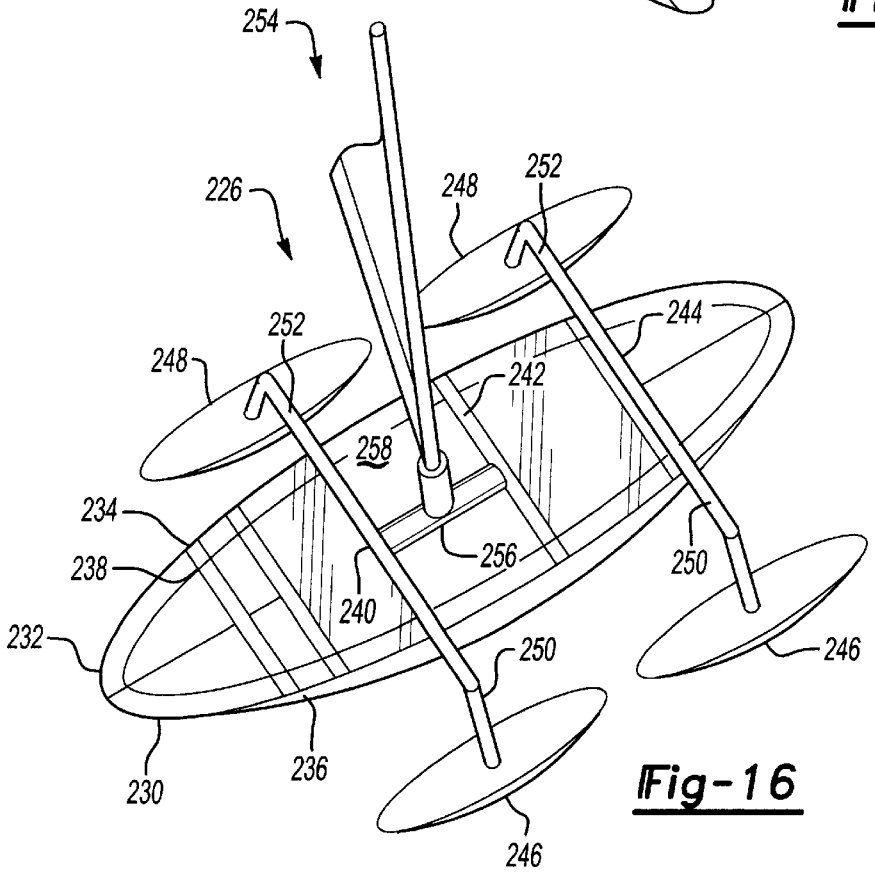
FIG. 16 is a perspective view of a still further configuration of a single engaged and converted hull, an elongate and tubular assembled frame secured atop the hull, and ice skate supports supported at remote extending ends of the frame for operating the sailing kit assembly atop an ice covered surface.

FIG. 16 illustrates a perspective view 226 of a still further configuration of a single engaged and converted hull 228 (defined by halves 230 and 232), an elongate and tubular assembled frame secured atop the hull (defined by longitudinally extending and curved tubular members 234 and 236 and cross wise extending members 238, 240, 242 and 244. Pairs of ice skate supports 246 and 248 are supported at remote extending ends 250 and 252 of additional tubular frame members for operating the sailing kit assembly atop an ice covered surface. A sail assembly 254 is secured in upwardly extending fashion from a suitable fitting 256 interconnected with the frame assembly and a planar and configured platform 258 may be attached atop the frame to support an operator.

Figure 17:
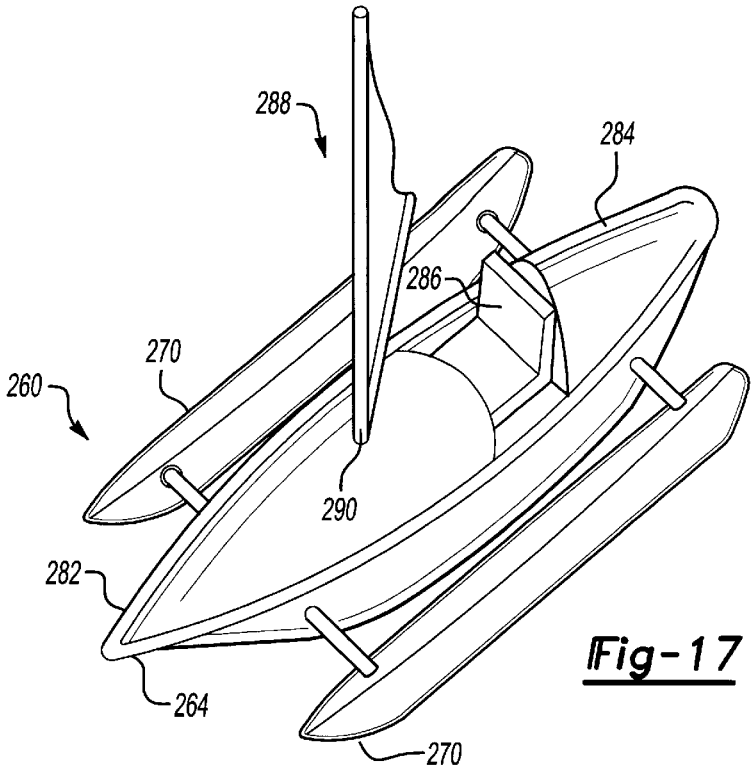
FIG. 17 is a perspective view of a yet further variant of a kit assembly and including a first engaged and converted hull, a pair of outriggers supported at lateral spaced locations from the hull by elongate frame members, and a canopy and seat for supporting an operator according to the present invention.
Figure 18:
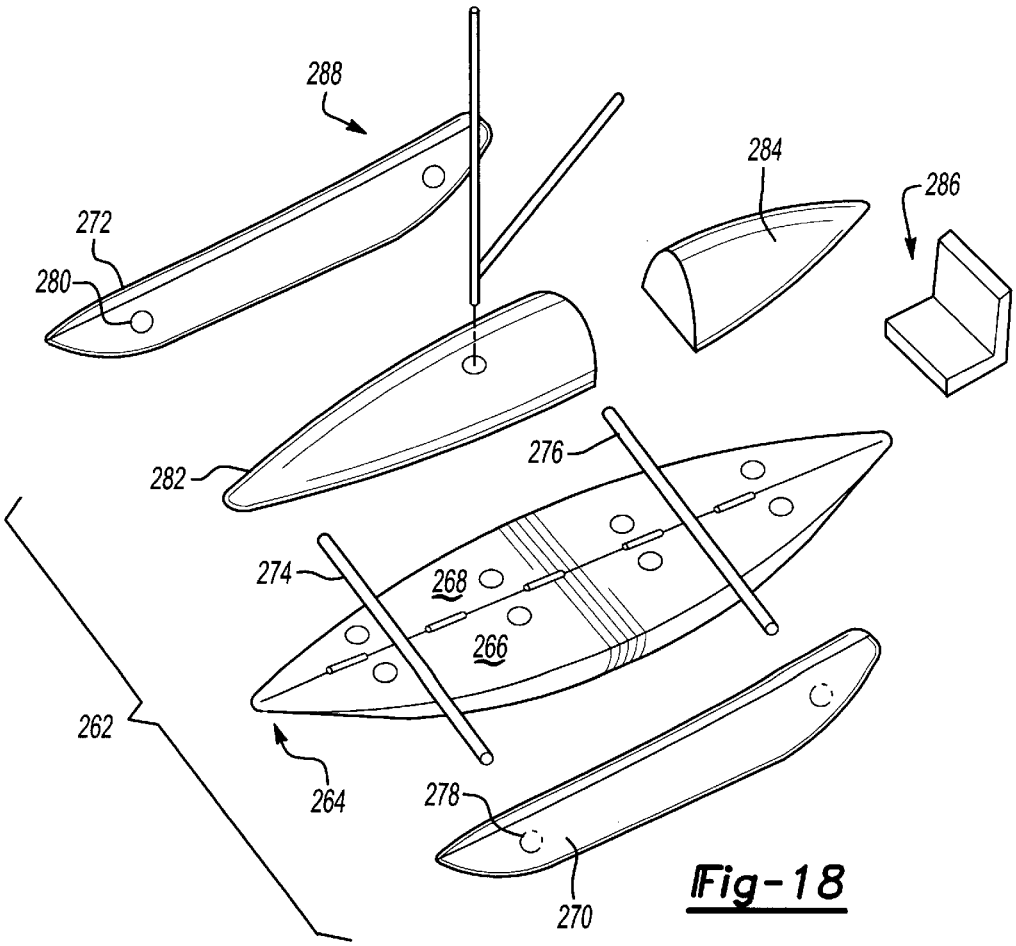
FIG. 18 is an exploded view of the variant illustrated in FIG. 17 according to the present invention.

FIGS. 17 and 18 illustrated perspective and exploded views, at 260 and 262, of a yet further variant of a kit assembly which includes a first engaged and converted hull 264 defined by hull halves 266 and 268. A pair of outriggers 270 and 272 are supported at lateral spaced locations from the hull 264 by elongate frame members 274 and 276. As is particularly illustrated in the exploded view of FIG. 18, apertures 278 and 280 may be formed laterally through the outriggers for supporting upon the frame members 274 and 276. A curved and ergonomic canopy is provided as a forward portion 282 and a rearward portion 284 which mount atop an upwardly planar surface of the hull 264 and are spaced apart to define an opening for permitting a seat 286 to be secured upon the hull 264. A mast assembly 288 may also secure through a location of the forward canopy section 282 (see at 290 in FIG. 17).

Figure 19:
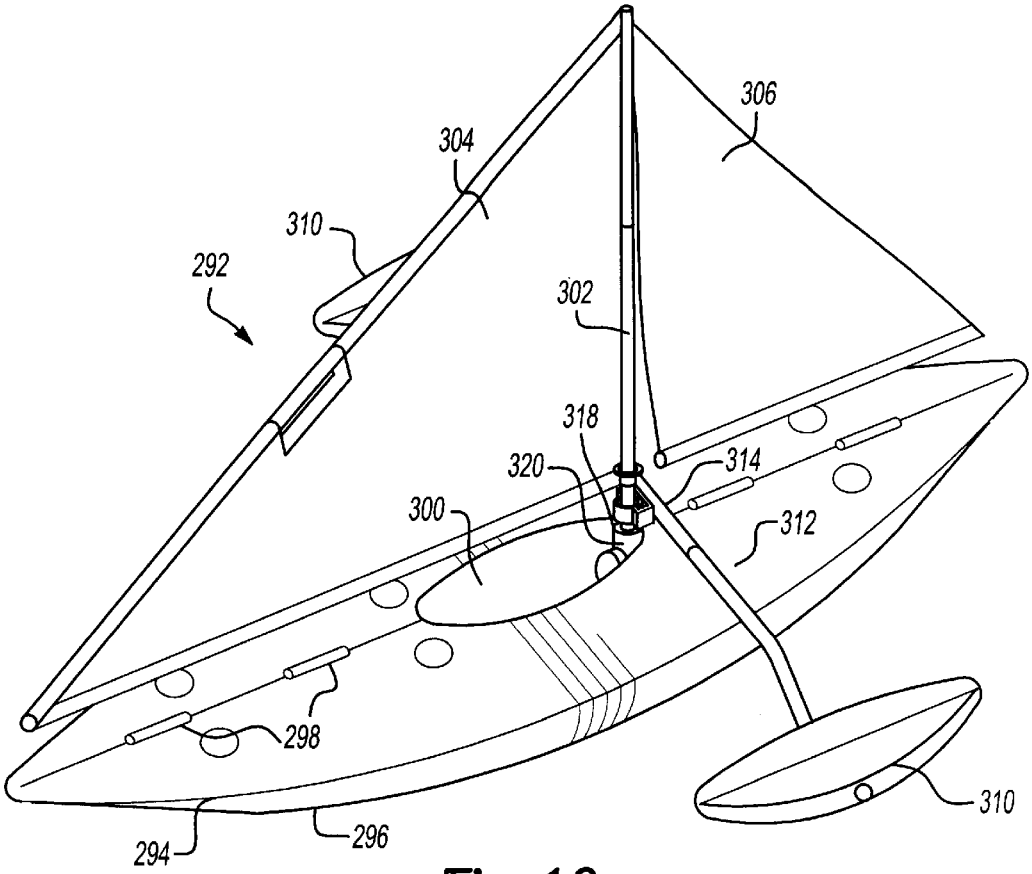
FIG. 19 is a perspective view of a further kayak variation of the multipurpose kit and illustrating attachable outriggers and mast.
Figure 20:
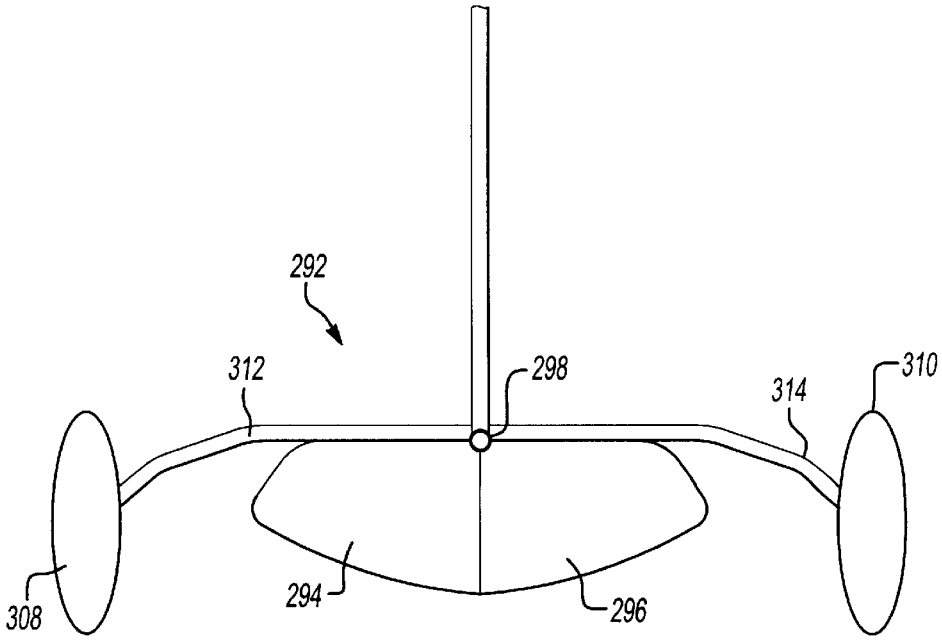
FIG. 20 is an end view of the variation illustrated in FIG. 19.

Referring now to FIGS. 19 and 20, a perspective view is illustrated at 292 of a further kayak variation of the multipurpose sailing kit. The kay also includes first and second pivotally secured halves 294 and 296, as previously described and best illustrated in the end view of FIG. 20 and including sleeve portions 298. Although illustrated in a wide-hull embodiment, it is understood that the halves 294 and 296 can be converted by pivoting about the sleeve portions 298 to define a taller and narrower configuration, as disclosed in earlier embodiments.

Figure 22:
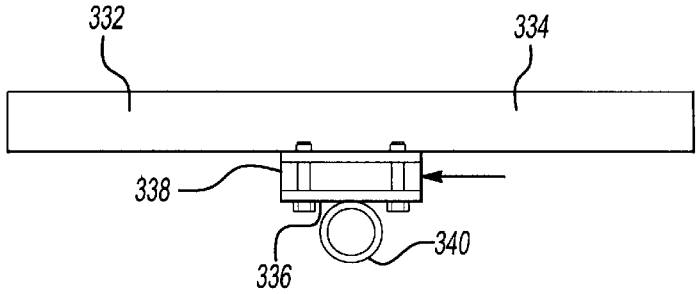
FIG. 22 is a top view of the rubberized mounting block for use with the mast and outrigger as shown in FIG. 21.

Referring back to FIG. 19, an aperture is defined at 300 within a top surface of the kayak and for providing a seat for the user. A mast assembly 302 extends upwardly from the kayak body proximate a forward edge of the seat aperture 300, the mast assembly 302 including provision for sails 304 and 306. The mast assembly 302 includes additional mounting structure, which will be referenced in the subsequent description of FIGS. 21 and 22, and which permits the attachment of outrigger portions 308 and 310 which are supported by configured brackets 312 and 314.

Figure 21:
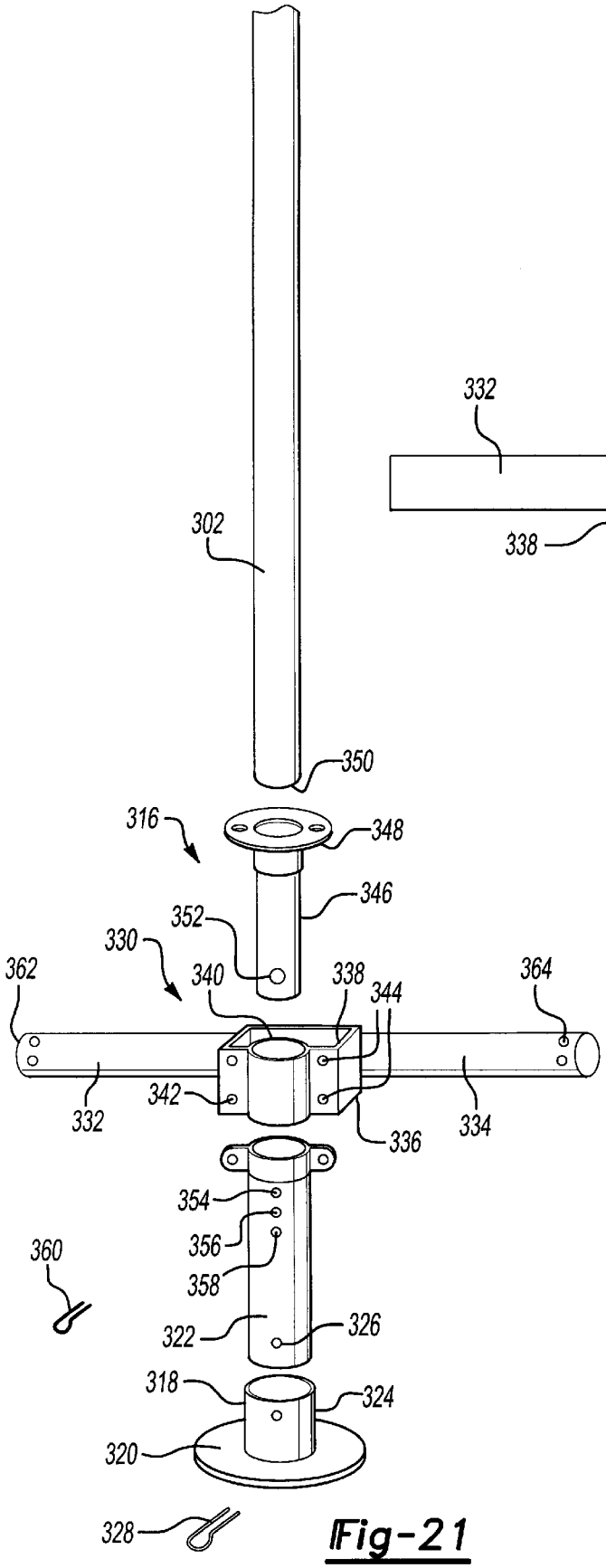
FIG. 21 is a sectional view in exploded fashion of the mounting structure for combination mast and outrigger assembly illustrated in FIG. 19.

Referring to FIG. 21, the mounting structure is illustrated at 316 in exploded fashion and includes a base mounting tubular portion 318 which secures to a top surface 320 of the boat (as also shown in FIG. 19). A first tube 322 is mounted in tubular coaxial fashion within the base portion 310 by aligning apertures 324 and 326. A first pin 328 secures the first tube 322 to the base portion 310.

An outrigger support bar is illustrated at 330 and includes first and second tubular and oppositely extending arms 332 and 334 which extend in substantially horizontal direction to the sides of the kayak and from a combined front face plate bracket 336 and supporting rubberized block 338. The rubberized block 338 separates the arms 332 and 334 from a front and vertically extending tubular portion 340, the tubular portion 340 being fastened to the rubberized block 338 by means of screws or the like which are secured through apertures 342 and 344 formed through side plates extending from the tubular portion 340.

Means are provided for securing the mast 302 to the mounting structure and include an additional intermediate mounting tube 346 which includes a coupling element 348 at an upper end thereof for attaching a corresponding bottom end portion 350 of the mast 302. An aperture 352 is formed in the corresponding bottom end intermediate tube 346 and the tube 346 is inserted in a downwardly extending direction through an interior of the vertically extending tubular portion 340. The lower portion of the tube 346 then passes through an upper interior of the first tube 322 and so that the aperture 352 is capable of being aligned with a selected one of three apertures 354, 356 and 358 formed in vertically spaced manner in the tube 322. A second pin 360 is capable of being inserted within a selected aperture 354, 356 or 358 which aligns with the aperture 352. Upon assembly of the mounting structure, inserting ends of the brackets 312 and 314, upon the ends of which are secured the outriggers 308 and 310, respectively, are secured such that apertures in the brackets (not shown) are aligned with additional such apertures 362 and 364 formed horizontally through the tubular arms 332 and 334, respectively, and within which are secured additional pins.

Figure 23:
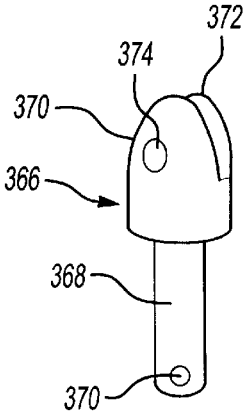
FIG. 23 is a view of an optional paddle rest and rowing aid.

Referring finally to FIG. 23, a view is shown of an optional paddle rust and rowing aid 366 which includes a shaft 368 with a lower horizontally configured aperture 370 and an upper oar support portion 370 having an upwardly/sidewardly facing curved aperture 372 for allowing insertion of a rowing oar (not shown). A pin hole 374 is illustrated in the oar support portion 370 and, as is known in the art, permits the insertion of pin fastener or the like to allow the oar to be attached.

Having described my invention, it will become apparent that it discloses a novel sailing kit assembly which permits the establishment of a number of different configurations utilizing only a single or a pair of convertible hulls. Numerous different and additional embodiments will become apparent to those skilled in the art to which it pertains without deviating from the scope of the appended claims.

I claim:

1. A multi-purpose sailing kit assembly, comprising:

at least one hull having first and second elongated, buoyant and self-contained halves, each of said self-contained halves further including in cross section a first planar surface and a second perpendicularly extending and planar surface connected to said first planar surface along a longitudinally extending and common edge;

means for pivotally securing said first and second halves together along a longitudinal direction and so that said halves are convertible from a first cross sectional profile to a second cross sectional profile, said means for pivotally securing further including a first plurality of spaced apart sleeve portion secured along a common edge of said first buoyant halve, a second plurality of spaced apart sleeve portions secured along a common edge of said second buoyant halve, said first and second pluralities of sleeve portions being aligned so as to define a common and elongate channel, at least one pin being insertably engaged within said channel in a longitudinal direction;

means for lockingly engaging said hull halves together in a selected profile, said means for lockingly engaging further including pluralities of circular openings formed at specified locations along said first and second planar surfaces of each hull halve, coupling mechanisms being provided for engaging said hull halves through selected and aligning openings and according to said selected cross sectional profile; and a sailing mast and means for mounting said mast atop said at least one hull.

2. The multi-purpose sailing kit assembly as described in claim 1, further comprising:

said hull halves each further including a nut fixedly secured along an inner surface thereof and in proximity to each of said circular openings, each of said nuts including a central through hole which is interiorly threaded;

said coupling mechanisms each further including a laterally extending shaft with first and second exteriorly threaded ends for engaging, respectively, a selected pair of aligning and threaded through holes, a disk being centrally and fixedly mounted to said shaft and assisting in securing said coupling mechanisms to said hull halves in a water sealing fashion.

3. The multi-purpose sailing kit assembly as described in claim 1, further comprising a plurality of rubberized plugs capable of being releasably secured within specified circular openings in said first and second hull halves not engaged by said coupling mechanisms.

4. The multi-purpose sailing kit assembly as described in claim 3, further comprising selected rubberized plugs secured along at least one exposed planar surface of said first and second halves further including a circular cavity for receiving an elongate tubular member in a horizontally inserting direction.

5. The multi-purpose sailing kit assembly as described in claim 3, said means for mounting said mast atop said hull further comprising selected rubberized plugs secured along at least one exposed planar surface of said first and second halves and further including a vertically extending circular cavity for receiving a stem portion of said mast.

6. The multi-purpose sailing kit assembly as described in claim 1, further comprising at least first and second outriggers capable of being secured in longitudinally extending fashion along selected edges of said first and second hull halves according to a selected profile.

7. The multi-purpose sailing kit assembly as described in claim 6, said outriggers further comprising a second hull with first and second elongated, buoyant and self-contained halves which are pivotally secured together and convertible between first and second profiles.

8. The multi-purpose sailing kit assembly as described in claim 1, said means for supporting further comprising a platform securing atop selected planar surfaces of each of said first and second hull halves.

9. The multi-purpose sailing kit assembly as described in claim 8, said platform further comprising a plurality of interconnecting tubular members.

10. The multi-purpose sailing kit assembly as described in claim 9, said platform further comprising a plurality of interconnecting tubular members.

11. The multi-purpose sailing kit assembly as described in claim 1, further comprising a canopy securing atop a selected pair of said first and second planar surfaces, said canopy further defining a forward portion and a spaced rearward portion, a seat installing in an aperture defined between said forward and rearward portions.

12. The multi-purpose sailing kit assembly as described in claim 11, said frame further comprising a plurality of interconnecting and tubular members securing between said upwardly facing planar surfaces and said canopy.

13. The multi-purpose sailing kit assembly as described in claim 10, said sailing kit assembly further comprising a kayak hull and said means for mounting said mast atop said hull further comprising a first tube and an intermediate mounting tube for interconnecting said sailing mast to a base mounting tubular portion secured to a floor location of said kayak.

14. The multi-purpose sailing kit assembly as described in claim 13, further comprising an outrigger attachment secured between said first tube and said intermediate mounting tube, said outrigger attachment including a vertically extending tubular portion, said outrigger attachment further including first and second opposite and laterally extending arms, configured brackets forming a portion of said outriggers and being received within said outrigger attachment arms, a rubber block element securing to said intermediate mounting tube and separating said outrigger attachment from said first tube and intermediate mounting tube.

15. A multi-purpose sailing kit assembly, comprising:

at least one hull having first and second elongated, buoyant and self-contained halves, each of said self-contained halves further including in cross section a first planar surface and a second perpendicularly extending and planar surface connected to said first planar surface along a longitudinally extending and common edge;

means for pivotally securing said first and second halves together along a longitudinal direction and so that said halves are convertible from a first cross sectional profile to a second cross sectional profile;

means for lockingly engaging said hull halves together in a selected profile;

a tubular frame assembly securing atop selected planar surfaces of said hull halves, at least first and second skate supports attaching to remote extending ends of said tubular frame assembly; and a sailing mast and means for mounting said mast atop said at least one hull.

16. A multi-purpose sailing kit assembly, comprising:

at least one hull having first and second elongated, buoyant and self-contained halves;

means for pivotally securing said first and second halves together along a longitudinal direction and so that said halves are convertible from a first cross sectional profile to a second cross sectional profile;

means for lockingly engaging said hull halves together in a selected profile;

at least first and second outriggers capable of being secured in longitudinally extending fashion along selected edges of said first and second hull halves according to a selected profile; and a sailing mast and means for mounting said mast atop said at least one hull.

17. A multi-purpose sailing kit assembly, comprising:

at least one hull having first and second elongated, buoyant and self-contained halves;

means for pivotally securing said first and second halves together along a longitudinal direction and so that said halves are convertible from a first cross sectional profile to a second cross sectional profile;

means for lockingly engaging said hull halves together in a selected profile, said means for lockingly engaging said hulls together further facilitating the disengagement of said first and second halves, and means for supporting said first and second disengaged hull halves at a spaced relationship; and a sailing mast and means for mounting said mast atop said at least one hull.

18. The multi-purpose sailing kit assembly as described in claim 17, further comprising a tubular frame assembly securing atop selected planar surfaces of said hull halves, at least first and second skate supports attaching to remote extending ends of said tubular frame assembly.

19. A multi-purpose sailing kit assembly, comprising:

first and second hulls including, respectively, first and second pairs of elongated, buoyant and self-contained halves;

means for pivotally securing said each of first and second pairs of hull halves along a longitudinal direction and so that said pairs of halves are each convertible from a first cross sectional profile to a second cross sectional profile;

means for lockingly engaging each of said pairs of hull halves together in a selected profile;

a horizontally extending platform securing said first and second pairs of hull halves in a desired spaced relationship; and a sailing mast and means for mounting said mast atop said platform.

20. A multi-purpose sailing kit assembly, comprising:

a hull having first and second elongated, buoyant and self-contained halves, each of said halves further including in cross section a first planar surface and a second perpendicularly extending and planar surface connected to said first planar surface along a longitudinally extending and common edge;

means for pivotally securing said first and second halves together along a longitudinal direction and so that said halves are convertible from a first cross sectional profile defining first upwardly facing planar surfaces to a second cross sectional profile defining second upwardly facing planar surfaces;

means for lockingly engaging said hull halves together in a selected profile;

at least first and second outriggers, said outriggers being mounted to said hull and so as to extend in longitudinally extending and spaced location relative to said hull; and a sailing mast and means for mounting said mast atop said at least one hull.

* * * * *